US006725572B1

(12) United States Patent
Krstic

(10) Patent No.: US 6,725,572 B1
(45) Date of Patent: Apr. 27, 2004

(54) PROTECTIVE FOOTWEAR AGAINST LANDMINE

(75) Inventor: Alexander Krstic, Salisbury (AU)

(73) Assignee: The Commonwealth of Australia, The Secretary of Defence (AU)

( * ) Notice: Subject to any disclaimer, the term of this patent is extended or adjusted under 35 U.S.C. 154(b) by 0 days.

(21) Appl. No.: 10/070,699

(22) PCT Filed: Sep. 7, 2000

(86) PCT No.: PCT/AU00/01059

§ 371 (c)(1),
(2), (4) Date: Jul. 9, 2002

(87) PCT Pub. No.: WO01/18479

PCT Pub. Date: Mar. 15, 2001

(30) Foreign Application Priority Data

Sep. 7, 1999 (AU) ..... PQ 2687

(51) Int. Cl.[7] ..... A43B 23/00; A43B 13/12

(52) U.S. Cl. ..... 36/25 R; 36/107; 36/30 R; 36/72 R

(58) Field of Search ..... 36/25 R, 30 R, 36/72 R, 75 R, 73, 107, 109, 85, 87, 1.5, 2 R, 113, 116

(56) References Cited

U.S. PATENT DOCUMENTS 3,516,181 A 6/1970 Jordan
4,184,273 A * 1/1980 Boyer et al. ..... 36/131
4,563,825 A * 1/1986 Tesser ..... 36/131
4,854,057 A * 8/1989 Misevich et al. ..... 36/114
5,177,884 A * 1/1993 Rullier ..... 36/117.2
5,926,977 A 7/1999 Sanders
5,979,081 A * 11/1999 Vaz ..... 36/107
5,992,056 A * 11/1999 Lohrmann ..... 36/44
6,006,646 A * 12/1999 Makris et al. ..... 89/36.05
6,505,421 B1 * 1/2003 Vaz ..... 36/30 R

FOREIGN PATENT DOCUMENTS

EP 1016355 A2 7/2000
EP 1016355 A3 9/2000
GB 2191384 * 12/1987

* cited by examiner

*Primary Examiner*—M. D. Patterson
(74) *Attorney, Agent, or Firm*—Cook, Alex, McFarron, Manzo, Cummings & Mehler, Ltd.

(57) ABSTRACT

Footwear (1) to protect a wearer from landmines including a substantialy non-deformable metal sheet (5) below the foot of the wearer shaped and positioned to effect a redirection of any up-welling result of an exploding landmine to a side of the footwear (1) when being worn. The footwear (1) also including an outer hard shell (2) to deflect and direct any initial shock and pressure waves past the body elements of the wearer, the footwear (1) being pivotally connected to an upper protective surround (13).

12 Claims, 5 Drawing Sheets

PROTECTIVE FOOTWEAR AGAINST LANDMINE

This invention relates to landmine protection arrangements and in particular, to articles that are associated with the foot and leg of an animal or person which or who may be vulnerable to a landmine explosion.

There has been an historical approach to providing protection against landmines which has provided for deformable members arranged to take some of the blast and shock and deformable outer parts of boots and other protection elements in the belief that this would be most beneficial.

The problem of protecting a lower limb or limbs and other parts of the human or animal body from an exploding landmine is a very difficult one indeed.

The problem to which this invention is directed is to provide an approach which has for its purpose reducing damage to the said human or animal parts in the event that a landmine is triggered by that person or animal.

In one form of this invention there is proposed an item of footwear adapted to be worn by a person or animal which item includes a substantially non-deformable metal sheet adapted to be positioned below the foot of a wearer characterised in that the sheet of metal is aligned so that an outer side which is a side further from the instep of a potential user, is higher than the portion of the sheet closer to the in-step side so as to effect a redirection of any up-welling as a result of an exploding landmine to an outer side of the item of footwear when being worn.

In preference, the sheet is generally planar and is positioned to assume an inclined orientation generally within the range relative to the horizontal of from ten degrees to fifty degrees such that in the event of an up-welling of the results of a landmine explosion, both preceding shock and pressure waves and any following pressure wave is to some extent diverted to an outer side.

By making such a sheet so that it will be substantially non-deformable, means that there will then be effected a substantial diversion to a side of at least preliminary shock and pressure waves and in relation to any following pressure wave there will be a lessening of the upward pressure on the plate both by reason of the alignment of the sheet and its positioning, and in preference by reason of additional materials and packaging and venting.

In preference, the article further includes an outer shell which is also hard rather than soft so that it is adapted to deflect and direct any initial shock and pressure waves past the body elements of the user.

A footwear upper shape having an outer shell made from polycarbonate plastic is typical of a suitable material for this purpose.

A next problem however relates to further parts of the lower limb of the user and in accord with a preferred further feature of this invention, there is proposed a protective surround which is made from a hard material adapted to further deflect shock and pressure waves and which has a lower rim which is adapted to fit within a surrounding outer part of a boot portion of the arrangement.

In preference, the footwear item is generally in the form of a boot and will be referred to as this subsequently. Accordingly the boot is connected to the protective surround by an interconnecting connection which is however adapted to allow for pivotal movement between the boot and the upper protective surround.

Such a pivotal connection allows for relative movement of the foot with respect to the lower part of the leg, in other words allowing for ankle movement, and this then allows for more comfortable ability to walk using this apparatus under normal conditions.

However, by having the connection of the boot coupled to the protective surround, means that an upward pressure will also transmit through the boot to the surround and therefore any substantial forces will be more generally dissipated through first the parts of the user's body in contact with the boot and also the protective surround.

In preference, the protective surround is tightly pulled and held with interlocking grip members so as to enable very tight close fitting engagement with the lower leg portion such as the calf and other parts of the lower leg of a user.

In preference, in relation to the substantially non-deformable sheet, there is a detonation material positioned on a lower face of this.

In explanation of this, there is now available material generally known as "DETSHEET" which is a detonation material which has the characteristics of detonating in the event of being subject itself to shock and pressure waves of the type first issued from an exploding landmine.

It has been discovered that by providing reactive shock and pressure waves in response to first shock and pressure waves which is primarily directed in an opposing direction to the first shock and pressure waves, has advantages in dissipating the first shock and pressure waves and to some extent, some following effects of the pressure wave.

Our proposal then is to provide for a detonation effect to be available to be triggered and arranged such that there will be a countering effect thus caused to an up-welling effect from an exploding landmine.

The substantially non-deformable sheet in preference substantially extends across the full sole area of the article of footwear.

In preference, the sheet is in the form of a metal plate of steel which for reasons of lightweight has ribs on a rear side both crosswise and longitudinally so as to provide for resistance against deformation about both longitudinal and transverse axes from an up-welling pressure wave.

In the item of footwear, there are further preferable features.

These include in the first instance a lowermost shape which comprises a plurality of open channels extending both longitudinal and transverse to allow for substantial venting through these.

The purpose of this arrangement is to allow for substantial venting in the first instance in the event of an exploding landmine.

Immediately above this lowermost sole portion in preference there is located above the substantially non-deformable sheet, at least one energy absorbing and dissipating barrier having a dissipatable material.

In preference then, there are a number of additional features including a lowermost frangible material and above this, in one case, a plurality of laminated sheets of kevlar impregnated fabric, and then above this, an open honeycomb structure.

For better understanding of the invention it will now be described with relation to a preferred embodiment, it being intended that the invention should not necessarily be limited to this.

Accordingly, this is now described with the assistance of drawings wherein.

Figure 1:
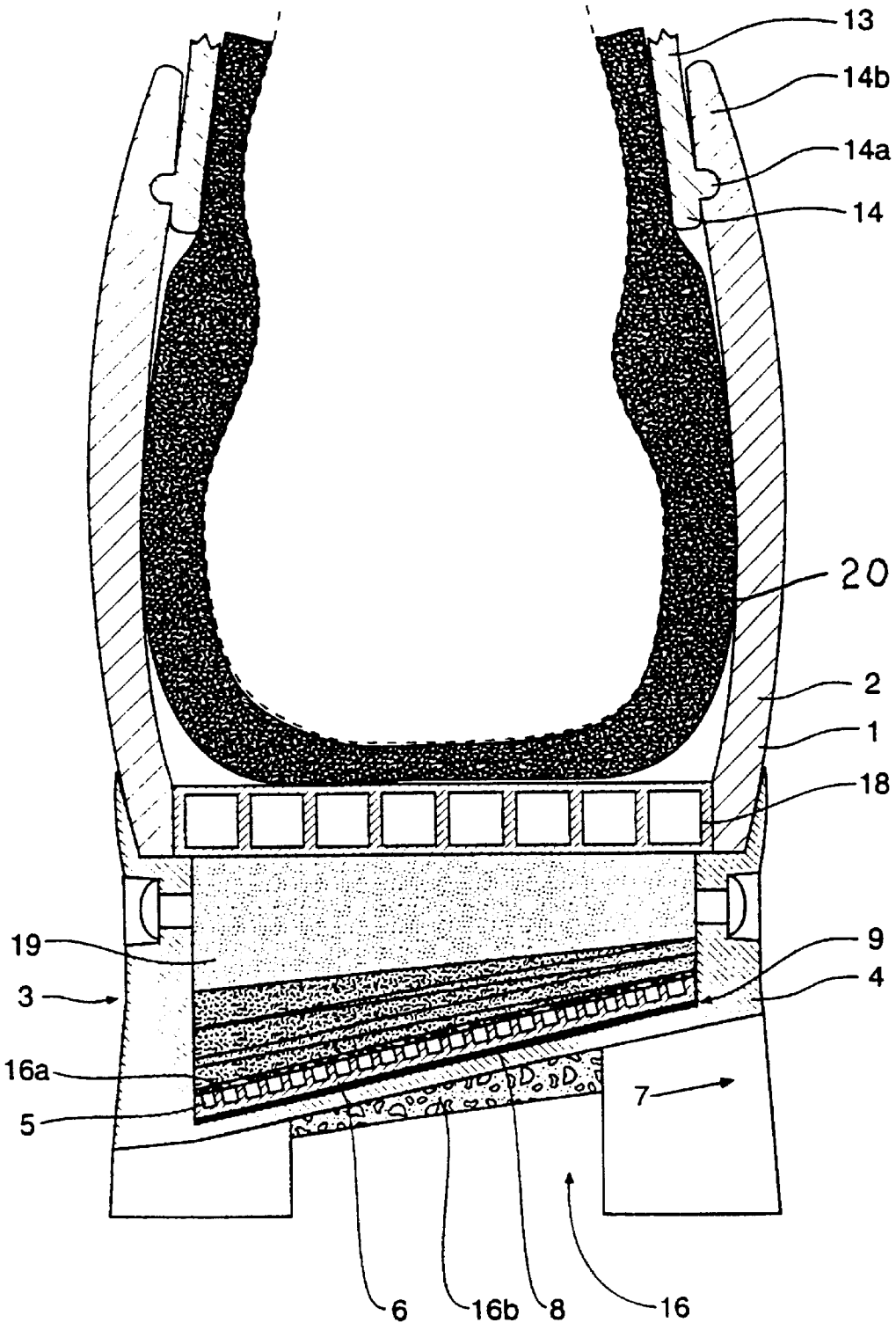
FIG. 1 is a schematic cross section of the arrangement according to the embodiment.
Figure 2:
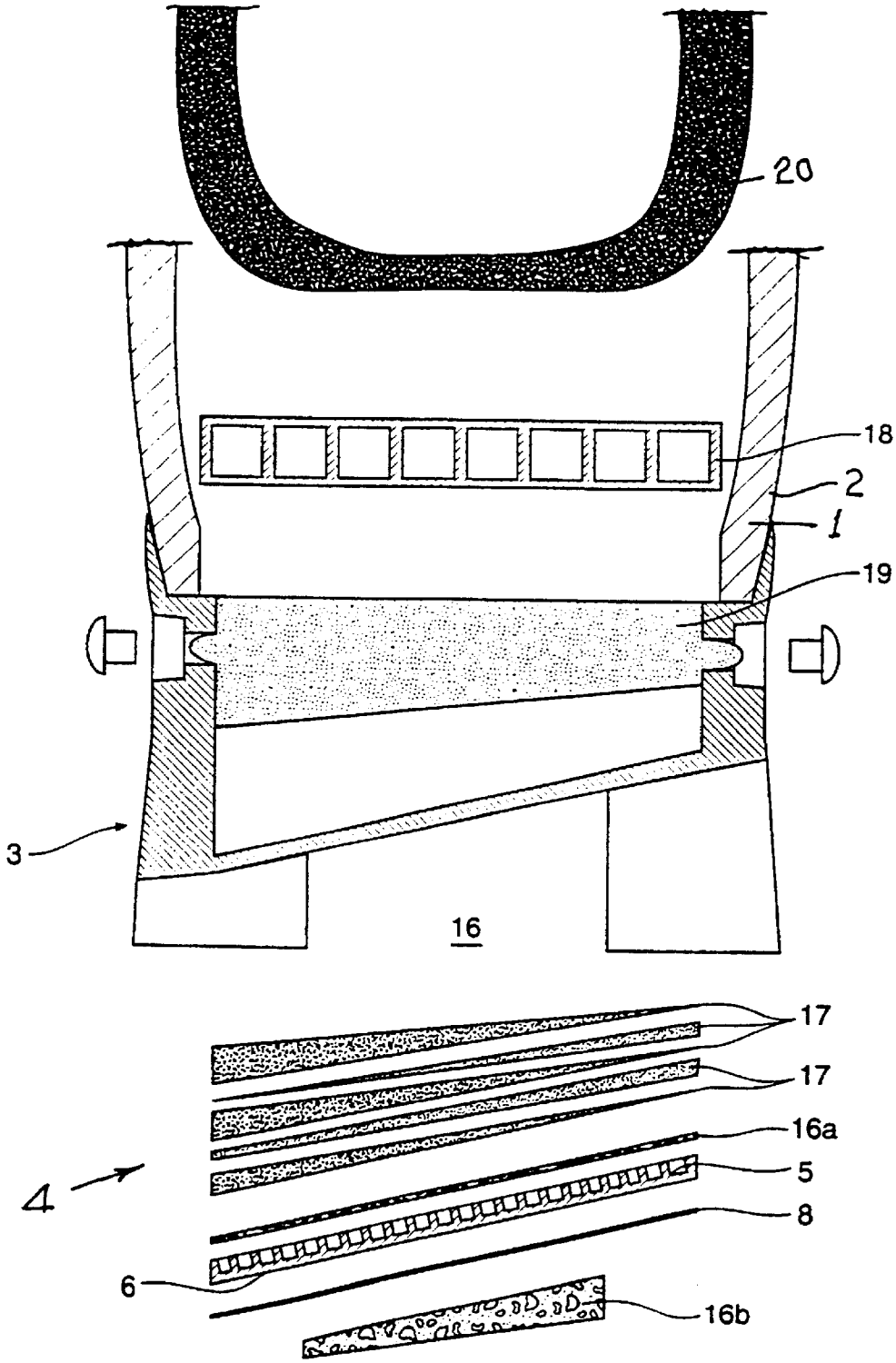
FIG. 2 is an exploded view of the parts as shown in FIG. 1.
Figure 3:
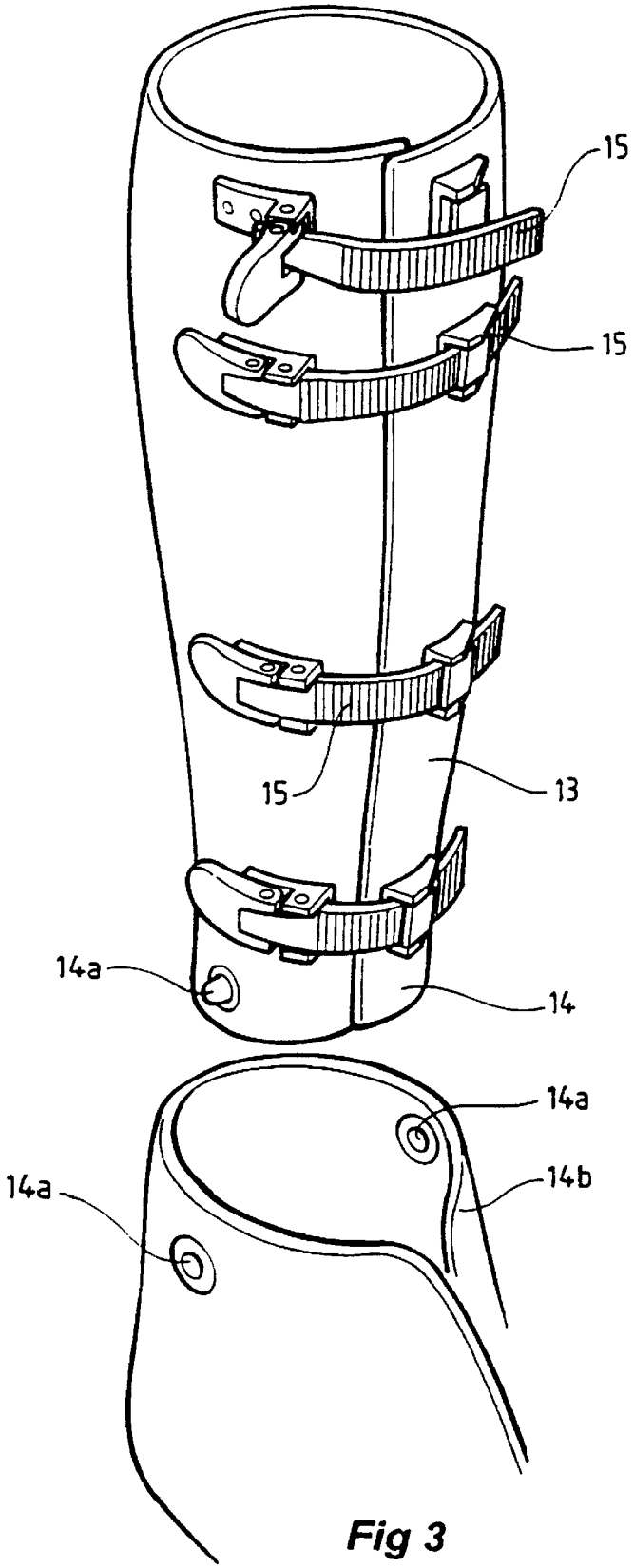
FIG. 3 is a perspective view of an upper part of the arrangement especially the protective surround of the embodiment.
Figure 4:
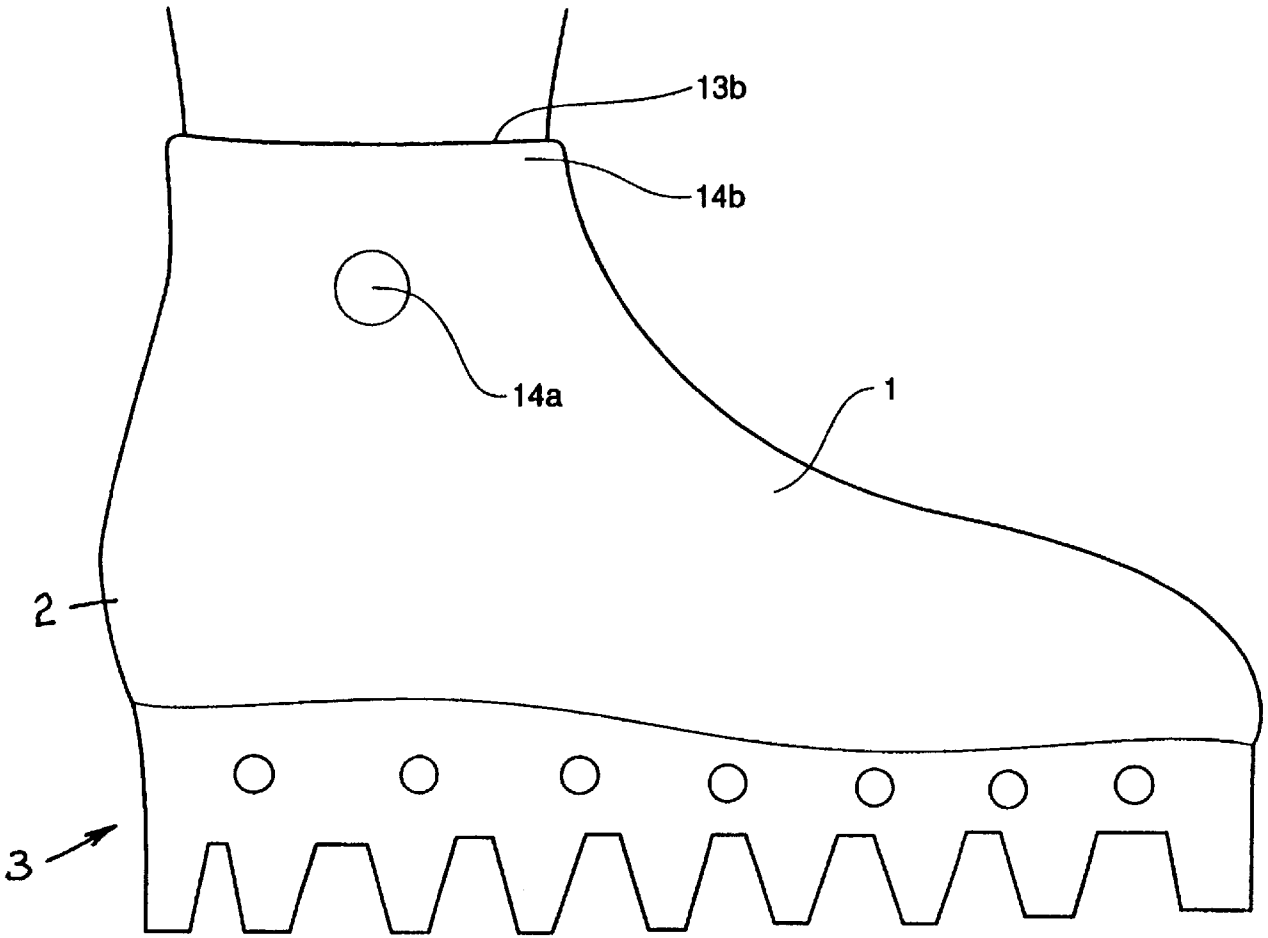
FIG. 4 is a side view of the boot with an inserted portion of the surround.
Figure 5:
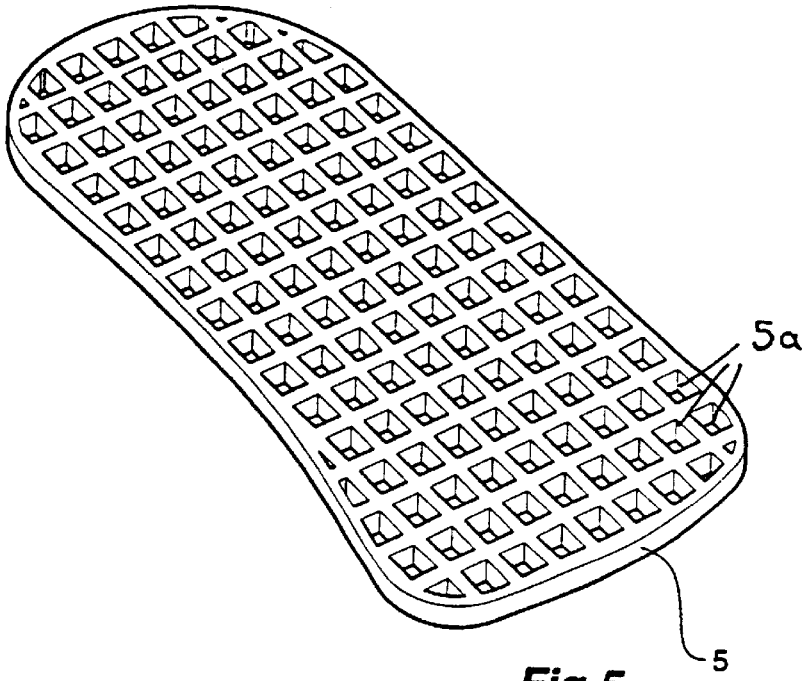
FIG. 5 is a perspective view of a metal plate used in the boot according to the first embodiment.
Figure 6:
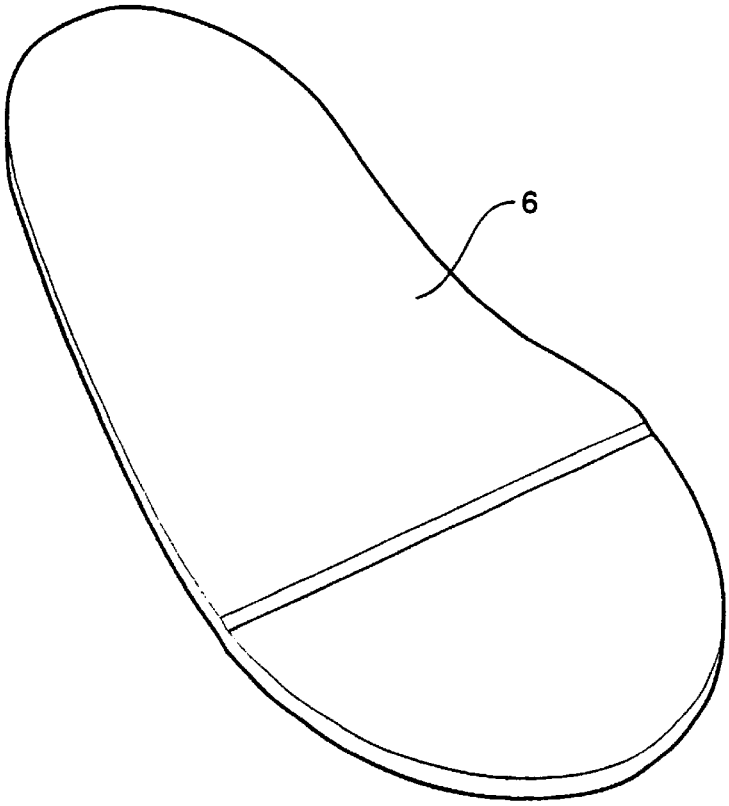
FIG. 6 is a perspective view of an underneath side of this.

Referring in details to the drawings the boot 1 includes an outer shell 2 to providing an upper, and generally attached to this but positioned below this, a sole assembly shown generally at 3.

In accordance with this arrangement, there is a matrix 4 within which there is a plate 5 which is positioned so as to provide an underneath surface 6 which is inclined to the horizontal and insofar that the surface is planar, presents an angle of approximately 20 degrees to the horizontal side to side which angle is selected so that any up-welling shock and pressure waves or the following pressure wave will be diverted in the direction as shown by arrow 7.

The direction of diversion shown by arrow 7 is chosen as it directs a substantial amount of the emerging blast wave away from the other leg of the wearer and thus avoiding further damage to another leg of the wearer.

The plate 5 is selected and shaped and otherwise positioned so that it is substantially non-deformable under the pressures of an exploding landmine in contrast to previous concepts where it is considered that some deformation will provide further energy absorption.

The discovery of this invention is that by providing the plate so that it will be inclined and therefore deflect the shock and pressure waves rather than absorbing them provides significant advantages.

The plate itself can be made from appropriate materials such as titanium and can be cast so as to have reduced weight howbeit with substantial thickness.

Positioned immediately below the plate 5 and attached to its underneath surface 6 is a sheet 8 which is a material generally known as detonation sheet or "DETSHEET" and this material has the characteristics that in the event of being subjected to the shock and pressure waves of an exploding landmine, this DETSHEET itself will explode. However by reason of this being back against the substantially non-deformable plate, it has been discovered that the effect of such a counteracting explosion is to counter some of the advancing shock and pressure waves and following pressure wave from the landmine and also to cause some diversion to this which is again beneficial to the user of the protection equipment.

The sheet of metal 5 is aligned so that an outer side 9 which is to say a side further from the instep of a potential user, is higher than the portion of the sheet closer to an in-step side 10.

The sheet 5 is generally planar and is positioned to assume an inclined orientation of approximately 20 degrees side to side but horizontal end to end such that in the event of an up-welling of the results of a landmine explosion, both preceding shock and pressure waves and any following pressure wave is to a substantial extent diverted to a side of the boot and of course away from the opposite leg of the user.

The boot 1 further has a hard outer shell 2 so that it is adapted to deflect and direct any initial shock and pressure waves past the body elements of the user.

The boot 1 to be hard in this context has its outer shell made from polycarbonate plastic.

A protective surround 13 is made from a hard material adapted to further deflect shock and pressure waves and which has a lower rim 14 which is adapted to fit within a surrounding upper outer part 14*b* of the boot 1.

The boot 1 is connected to the protective surround 13 by an interconnecting connection 14*a* which is however adapted to allow for pivotal movement between the boot and the upper protective surround 13.

Such a pivotal connection 14*a* allows for relative movement of the foot with respect to the lower part of the leg allowing for ankle movement and this then allows for a more comfortable ability to walk using this footwear under normal walking conditions.

However, by having the connection of the boot 1 coupled to the protective surround 13, means that an upward pressure will also transmit through the boot to the surround and therefore any substantial forces will be more generally dissipated through first the parts of the user's body in contact with the boot and also the protective surround 13.

The protective surround 13 is tightly pulled and held with interlocking grip members 15 so as to enable very tight close fitting engagement with the lower leg portion such as the calf and other parts of the lower leg of a user.

The substantially non-deformable sheet 5 extends across the full sole area of the article of footwear.

The sheet 5 is in the form of a metal plate of steel which for reasons of lightweight has ribs 5*a* on a rear side extending both crosswise and longitudinally so as to provide for resistance against deformation about both longitudinal and transverse axes from an up-welling pressure wave without adding unduly to an all up-weight of the footwear.

Further features include a lowermost shape which comprise a plurality of open channels 16 extending both longitudinal and transverse to allow for substantial venting through these. Immediately above this is a frangible absorbing layer 16*b*.

The purpose of this arrangement is to allow for substantial venting in the first instance in the event of an exploding landmine.

Immediately above this lowermost sole portion there is located above the substantially non-deformable sheet 5, energy absorbing and dissipating barrier layers having an energy dissipatable material.

There is a frangible material at 16*a* and above this a plurality of laminated sheets of kevlar impregnated fabric of wedge shape 17, and then above this, an open honeycomb structure 18.

Further energy dissipation material is located as a plug at 19.

There is also a sock of softer foam material at 20 to act as an energy spreader and act as a soft interface between the harder material of the boot and the foot of a wearer.

This then describes the embodiment that currently provides advantages sought.

What is claimed is:

1. An item of footwear for protecting the foot and lower leg of a wearer thereof from injury due to accidental detonation of a landmine, said item of footwear comprising a sole having an instep side and an outer side, a toe and a heel, an upper portion attached to said sole, said upper portion formed of a hard material, and a non-deformable metal plate positioned in said sole and extending from said instep side to said outer side and from said toe to said heel, said non-deformable metal plate tilted upwardly from said instep side to said outer side of said sole to effect a redirection of any up-welling to said outer side of said sole as a result of an exploding land mine.

2. The item of footwear of claim 1 further characterized in that said non-deformable metal plate is generally planer and is tilted upwardly from said instep side to said outer side of said sole within a range relative to the horizontal of from approximately 10 degrees to approximately 50 degrees.

3. The item of footwear of claim 1 further characterized in that said hard material of said upper portion is a polycarbonate plastic.

4. The item of footwear of claim 1 further including a protective surround which telescopes into said upper portion.

5. The item of footwear of claim 4 further characterized in that said protective surround is pivotally connected to said upper portion.

6. The item of footwear of claim 4 further characterized in that said protective surround includes a plurality of interlocking grip members for tightening said protective surround relative to a leg of a user.

7. The item of footwear of claim 1 further including a detonation material positioned beneath said non-deformable metal plate.

8. The item of footwear of claim 1 further characterized in that said non-deformable metal plate has an upper surface and a lower surface with criss-crossed ribs formed on said upper surface of said non-deformable metal plate.

9. The item of footwear of claim 1 further characterized in that an energy absorbing and dissipating barrier is installed above said non-deformable metal plate.

10. The item of footwear of claim 1 further characterized in that a frangible absorbing layer is positioned below and a plurality of laminated sheets of kevlar impregnated fabric are positioned above said non-deformable metal plate.

11. The item of footwear of claim 10 further characterized in that an open honey comb structure is positioned above said laminated sheets of kevlar impregnated fabric.

12. The item of footwear of claim 1 further characterized in that said non-deformable metal plate is generally planer and is tilted upwardly from said instep side to said outer side of said sole at an angle of approximately 20 degrees relative to the horizontal.

* * * * *